US010968907B2

(12) United States Patent
Ahn et al.

(10) Patent No.: US 10,968,907 B2
(45) Date of Patent: Apr. 6, 2021

(54) LINEAR COMPRESSOR

(71) Applicants: LG ELECTRONICS INC., Seoul (KR); INDUSTRY-ACADEMIC COOPERATION FOUNDATION, YONSEI UNIVERSITY, Seoul (KR)

(72) Inventors: Kwangwoon Ahn, Seoul (KR); Sungyong Ahn, Seoul (KR); Yoonchul Rhim, Seoul (KR)

(73) Assignees: LG Electronics Inc. and Industry-Academic Cooperation, Seoul (KR); Foundation, Yonsei University, Seoul (KR)

( * ) Notice: Subject to any disclaimer, the term of this patent is extended or adjusted under 35 U.S.C. 154(b) by 441 days.

(21) Appl. No.: 15/865,966

(22) Filed: Jan. 9, 2018

(65) Prior Publication Data

US 2018/0195502 A1 Jul. 12, 2018

(30) Foreign Application Priority Data

Jan. 10, 2017 (KR) ..... 10-2017-0003722

(51) Int. Cl.
*F04B 39/02* (2006.01)
*F04B 35/04* (2006.01)
(Continued)

(52) U.S. Cl.
CPC ..... *F04B 39/0292* (2013.01); *F04B 35/04* (2013.01); *F04B 35/045* (2013.01);
(Continued)

(58) Field of Classification Search
CPC .. F04D 39/0292; F04D 39/0005; F04D 35/04; F04D 35/045; F04D 53/008; F04D 53/123; F04D 53/14
See application file for complete search history.

(56) References Cited

U.S. PATENT DOCUMENTS 2,495,516 A * 1/1950 Foster ..... F16F 9/063 267/64.15
2,968,287 A * 1/1961 Creighton ..... F01B 1/0644 92/156
(Continued)

FOREIGN PATENT DOCUMENTS

CN 101004169 7/2007
CN 203906210 10/2014
(Continued)

OTHER PUBLICATIONS

European Extended Search Report in European Application No. 18150925.8, dated May 16 2018, 7 pages.
(Continued)

*Primary Examiner* — Christopher S Bobish
(74) *Attorney, Agent, or Firm* — Fish & Richardson P.C.

(57) ABSTRACT

A linear compressor includes a cylinder that defines a compression chamber configured to accommodate refrigerant and that includes a cylinder nozzle configured to receive refrigerant, and a piston provided in the cylinder and configured to be pressed by refrigerant in the cylinder. The piston includes a piston body configured to move forward and backward within the cylinder, a piston front part located on a front surface of the piston body, the piston front part comprising a suction port through which refrigerant is supplied into the compression chamber, and a refrigerant collection part that is recessed from an outer circumferential surface of the piston front part, that extends to a front surface of the piston front part, and that is configured to receive at least a portion of refrigerant compressed in the compression chamber.

20 Claims, 12 Drawing Sheets

(51) Int. Cl.

| | |
|---|---|
| ***F04B 39/00*** | (2006.01) |
| ***F04B 53/00*** | (2006.01) |
| ***F04B 53/14*** | (2006.01) |
| ***F04B 53/12*** | (2006.01) |

(52) U.S. Cl.
CPC ..... *F04B 39/0005* (2013.01); *F04B 53/008* (2013.01); *F04B 53/123* (2013.01); *F04B 53/14* (2013.01)

(56) References Cited

U.S. PATENT DOCUMENTS

| | | | | | |
|---|---|---|---|---|---|
| 3,035,879 | A * | 5/1962 | Hanny | F16J 15/44 | 92/112 |
| 3,227,094 | A * | 1/1966 | Cailloux | F04B 53/1002 | 417/464 |
| 3,631,766 | A * | 1/1972 | Kraakman | F03C 1/001 | 92/162 P |
| 4,050,360 | A * | 9/1977 | Powers | F04B 39/0005 | 92/127 |
| 4,389,922 | A * | 6/1983 | Tatters | F16N 27/02 | 184/18 |
| 4,545,738 | A * | 10/1985 | Young | F04B 39/0005 | 417/437 |
| 4,644,851 | A * | 2/1987 | Young | F04B 39/0005 | 417/437 |
| 4,932,313 | A * | 6/1990 | Gutknecht | F15B 15/1447 | 384/115 |
| 7,913,613 | B2 * | 3/2011 | Muth | F04B 35/045 | 92/169.1 |
| 9,494,148 | B2 * | 11/2016 | Ahn | F04B 39/0005 | |
| 9,739,276 | B2 * | 8/2017 | Muth | F04B 39/0005 | |
| 10,125,754 | B2 * | 11/2018 | Ahn | F04B 39/0005 | |
| 10,273,955 | B2 * | 4/2019 | Bean | F04B 53/166 | |
| 10,352,313 | B2 * | 7/2019 | Ha | F04B 39/126 | |
| 2007/0166176 | A1 | 7/2007 | Kang et al. | | |
| 2010/0021323 | A1 * | 1/2010 | Schubert | F04B 35/045 | 417/416 |
| 2010/0310394 | A1 * | 12/2010 | Giacchi | F04B 35/045 | 417/417 |
| 2013/0058816 | A1 * | 3/2013 | Kim | F04B 35/045 | 417/437 |
| 2014/0053720 | A1 | 2/2014 | Ahn et al. | | |
| 2015/0369224 | A1 * | 12/2015 | Kim | F04B 39/126 | 417/443 |
| 2015/0369238 | A1 * | 12/2015 | Park | F04B 35/045 | 417/437 |

FOREIGN PATENT DOCUMENTS

| | | |
|---|---|---|
| CN | 104454445 | 3/2015 |
| DE | 102008007661 | 8/2009 |
| EP | 2700816 | 2/2014 |
| KR | 10-1307688 | 5/2009 |
| KR | 10-2016-0000324 | 1/2016 |
| SU | 1525313 | 10/1989 |

OTHER PUBLICATIONS

Chinese Office Action in Chinese Appln. No. 201810015341.4, dated Dec. 20, 2018, 16 pages (with English translation).

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2017-0003722, filed on Jan. 10, 2017, which is hereby incorporated by reference in its entirety.

FIELD

The present disclosure relates to a linear compressor.

BACKGROUND

A cooling system may circulate refrigerant to generate cool air. For example, a cooling system may perform processes of compressing, condensing, expanding, and evaporating of the refrigerant and repeat those processes. In some examples, the cooling system may include a compressor, a condenser, an expansion device, and an evaporator. The cooling system may be installed in a home appliance such as a refrigerator or an air conditioner.

A compressor may receive power from a power generation device such as an electric motor or a turbine to compress air, refrigerant, or various working gases, thereby increasing a pressure thereof. The compressors have been widely used in home appliances or industrial fields.

The compressor may be classified into a reciprocating compressor, a rotary compressor, or a scroll compressor based on a compression chamber into/from working gas or refrigerant is suctioned and discharged. For example, a compression chamber in a reciprocating compressor is defined between a piston and a cylinder to allow the piston to be linearly reciprocated into the cylinder, thereby compressing refrigerant. A compression chamber in a rotary compressor is defined between a roller that eccentrically rotates and a cylinder to allow the roller to eccentrically rotate along an inner wall of the cylinder, thereby compressing a refrigerant. A compression chamber in a scroll compressor is defined between an orbiting scroll and a fixed scroll to compress refrigerant while the orbiting scroll rotates along the fixed scroll.

In recent years, a linear compressor, which is directly connected to a driving motor and includes a piston that linearly reciprocates, is being widely developed to improve compression efficiency without mechanical losses due to motion conversion. In some cases, the linear compressor may have a simple structure. For example, the linear compressor suctions and compresses refrigerant within a sealed shell while a piston linearly reciprocates within the cylinder by a linear motor and then discharges the compressed refrigerant.

In some examples, the linear motor is configured to allow a permanent magnet to be disposed between an inner stator and an outer stator. The permanent magnet can be driven to linearly reciprocate by electromagnetic force between the permanent magnet and the inner (or outer) stator. In some cases, since the permanent magnet operates in a state where the permanent magnet is connected to the piston, the permanent magnet may suction and compress refrigerant while linearly reciprocating within the cylinder and then discharge the compressed refrigerant.

In some examples, the linear compressor may be disposed in a refrigerator in a machine room that is provided at a rear lower side of a refrigerator. In these cases, the linear compressor may include a shell for accommodating a plurality of components. A vertical height of the shell may be relatively high. In some examples, an oil supply assembly for supplying oil between a cylinder and a piston may be disposed within the shell.

In recent years, one interest of customers is an increase of an inner storage space of the refrigerator. To increase the inner storage space of the refrigerator, it may be necessary to reduce a volume of the machine room. In some cases, to reduce the volume of the machine room, reduction in size of the linear compressor has become a major issue.

In some examples, the linear compressor may have a relatively large volume, and it is necessary to also increase the volume of the machine room in which the linear compressor is accommodated. In this case, the linear compressor may not be adequate for the refrigerator for increasing the inner storage space thereof.

To reduce the size of the linear compressor, it may be necessary to reduce a size of a main component of the compressor. In this case, the compressor may be deteriorated in performance.

To compensate the deteriorated performance of the compressor, it may be considered that the compressor increases a driving frequency. However, when the compressor increases a driving frequency, noises may increase due to opening and closing of a suction valve or a discharge valve provided in the compressor or due to flow of refrigerant.

In some examples, the linear compressor may include a gas bearing in which refrigerant gas is supplied in a space between a cylinder and a piston to perform a bearing function. The refrigerant gas flows to an outer circumferential surface of the piston through a nozzle of the cylinder to act as a bearing in the reciprocating piston.

In these examples, a portion of the refrigerant compressed in the compression chamber may flow backward without being discharged from the compression chamber and then be introduced into a space between an inner circumferential surface of the cylinder and the piston. The introduced high-pressure refrigerant may act as a gas bearing of a front portion of the piston.

In some cases, the introduced high-pressure refrigerant may cause a non-uniform gap between the inner circumferential surface of the cylinder and the outer circumferential surface of the piston. For example, when a center of the piston does not match a center of the cylinder, or when the high-pressure refrigerant is introduced in a state in which the piston is lean to one side within the cylinder, a large amount of refrigerant may be introduced into a space having a relatively large gap. In this case, the space having the relatively large gap may be more narrowed to cause reduction of the gap, thereby causing friction between the cylinder and the piston.

In examples where a more amount of high-pressure refrigerant is introduced into an upper portion of the space between the inner circumferential surface of the cylinder and the outer circumferential surface of the piston, a gap at the upper portion may increase, and a gap at a lower portion may decrease. Thus, friction may occur between a lower portion of the outer circumferential surface of the piston and a lower portion of the inner circumferential surface of the cylinder. In this case, a loss due to the friction may deteriorate compression efficiency of the compressor.

SUMMARY

This disclosure may provide a linear compressor that improves performance of a gas bearing supplied into a piston.

This disclosure may provide a linear compressor in which a high-pressure refrigerant compressed in a compression chamber flows backward between an outer circumferential surface of a piston and an inner circumferential surface of a cylinder. The refrigerant may prevent friction between the piston and the cylinder from occurring due to an increase in gap between the piston and the cylinder.

This disclosure may provide a linear compressor in which at least a portion of a high-pressure refrigerant compressed in a compression chamber flows to a refrigerant collection part of a piston while the piston moves forward to compress the refrigerant in the compression chamber. The refrigerant may reduce force of the high-pressure refrigerant, which is capable of increasing a gap between the piston and the cylinder.

This disclosure may also provide a linear compressor in which a refrigerant collected into a refrigerant collection part is suctioned into the compression chamber while a piston moves backward to allow a low-pressure refrigerant to be suctioned into the compression chamber through a suction port of the piston, and thereafter, a high-pressure refrigerant is collected again into the refrigerant collection part while the refrigerant in the compression chamber is compressed.

According to one aspect of the subject matter described in this application, a linear compressor includes a cylinder that defines a compression chamber configured to accommodate refrigerant and that includes a cylinder nozzle configured to receive refrigerant, and a piston provided in the cylinder and configured to be pressed by refrigerant in the cylinder. The piston includes a piston body configured to move forward and backward within the cylinder, a piston front part located on a front surface of the piston body, the piston front part comprising a suction port through which refrigerant is supplied into the compression chamber, and a refrigerant collection part that is recessed from an outer circumferential surface of the piston front part, that extends to a front surface of the piston front part, and that is configured to receive at least a portion of refrigerant compressed in the compression chamber.

Implementations according to this aspect may include one or more of the following features. For example, the linear compressor may further include a suction valve provided at a front side of the piston front part and configured to open and close the suction port. The refrigerant collection part may include a discharge part configured to be closed by the suction valve. The piston body may be spaced apart from the cylinder to define a gap part between an outer circumferential surface of the piston body and an inner circumferential surface of the cylinder, where the gap part allows at least a portion of refrigerant compressed in the compression chamber to flow around the piston body.

In some examples, the refrigerant collection part may further include an inflow part that is provided at the outer circumferential surface of the piston front part and that communicates with the gap part. The refrigerant collection part may further include a connection passage that is provided in the piston front part and that extends from the inflow part to the discharge part. The connection passage may include a first passage part connected to the inflow part and recessed from the outer circumferential surface of the piston front part, and a second passage part that extends from the first passage part to the discharge part. The second passage part may be bent from the first passage part toward the discharge part. A cross-sectional area of the first passage part may be greater than a cross-sectional area of the second passage part.

In some implementations, the suction valve may be configured to, based on the piston moving forward to compress refrigerant in the compression chamber, close the suction port and the refrigerant collection part. In some examples, the suction valve may be configured to, based on the piston moving backward, open the suction port and the refrigerant collection part to allow refrigerant to be introduced into the compression chamber through the suction port and the refrigerant collection part.

In some implementations, the linear compressor may further include a discharge valve provided at a side of the compression chamber and configured to open and close at least a portion of the compression chamber, where the discharge valve is configured to, based on the discharge valve opening at least the portion of the compression chamber, allow at least a portion of refrigerant compressed in the compression chamber to discharge from at least the portion of the compression chamber to the cylinder nozzle.

According to another aspect, a linear compressor includes a cylinder that defines a compression chamber configured to receive refrigerant, a piston provided in a side of the compression chamber and configured to move forward and backward in the compression chamber, a suction port provided in the piston and configured to guide refrigerant to the compression chamber, a suction valve coupled to a front surface of the piston and configured to open and close the suction port, a gap part defined between an outer circumferential surface of the piston and an inner circumferential surface of the cylinder, the gap part being configured to allow at least a portion of refrigerant compressed in the compression chamber to flow through the gap part around the piston, and a refrigerant collection part that communicates with the gap part, that is recessed from the piston, and that is configured to receive refrigerant from the gap part. The suction valve is configured to open and close the refrigerant collection part.

Implementations according to this aspect may include one or more of the following features. For example, the refrigerant collection part may include an inflow part provided at the outer circumferential surface of the piston, and a discharge part provided in the front surface of the piston, and the suction valve may be configured to open and close the discharge part of the refrigerant collection part. The refrigerant collection part may further include a connection passage that extends from the inflow part to the discharge part.

In some examples, the connection passage may include a first passage part recessed from the outer circumferential surface of the piston, and a second passage part that extends from the first passage part to the front surface of the piston. The linear compressor may further include a discharge valve provided at a side of the compression chamber and configured to discharge refrigerant compressed in the compression chamber, and a cylinder nozzle provided in the cylinder and configured to, based on the discharge valve being opened, guide, to the gap part, a portion of the refrigerant that is discharged from the compression chamber.

In some examples, the cylinder nozzle may include a first nozzle disposed at a front side with respect to a central line that crosses an axial direction of the cylinder, and a second nozzle disposed at a rear side with respect to the central line that crosses the axial direction of the cylinder. The cylinder nozzle may include a plurality of nozzles. The suction valve may be further configured to, based on a direction of movement of the piston in the cylinder, open and close the discharge part of the refrigerant collection part.

The details of one or more implementations are set forth in the accompanying drawings and the description below.

Other features will be apparent from the description and drawings, and from the claims.

DETAILED DESCRIPTION

Hereinafter, exemplary implementations will be described with reference to the accompanying drawings. The disclosure may, however, be embodied in many different forms and should not be construed as being limited to the implementations set forth herein; rather, that alternate implementations included in other retrogressive disclosures or falling within the spirit and scope of the present disclosure will fully convey the concept of the disclosure to those skilled in the art.

Figure 1:
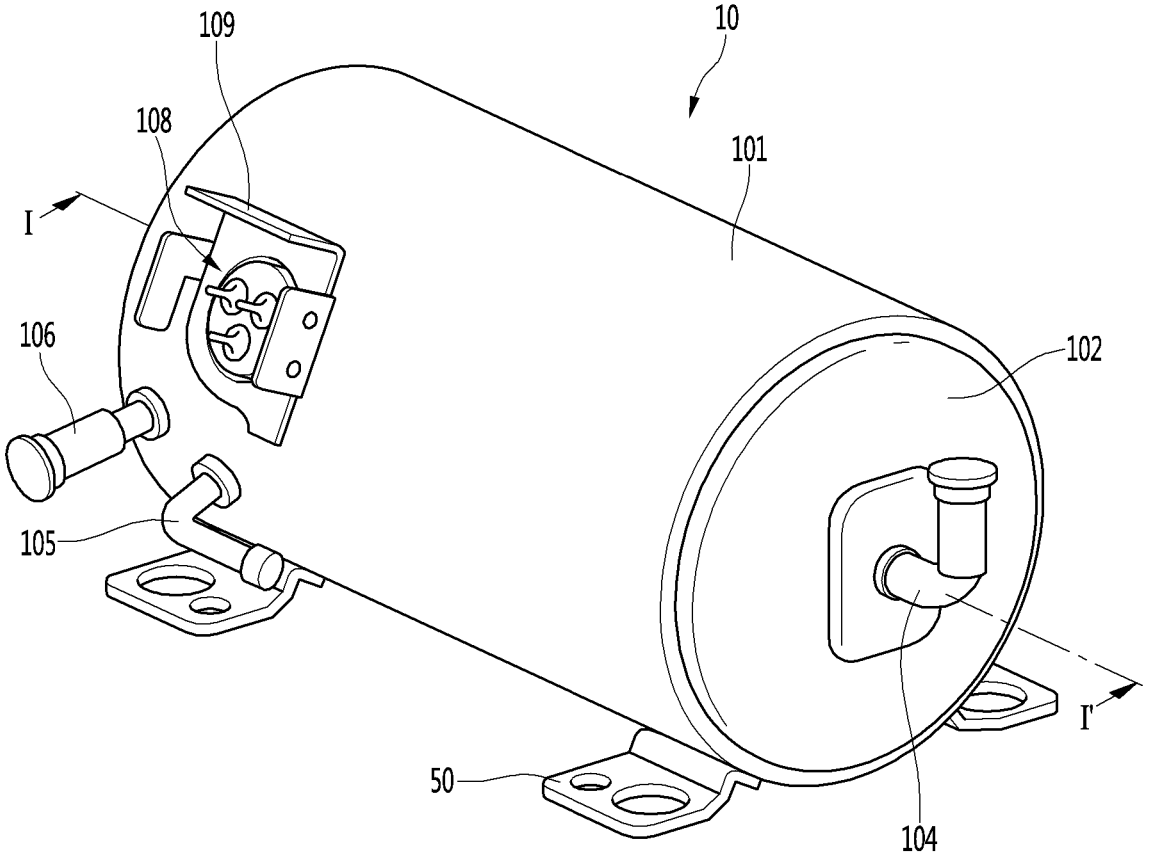
FIG. 1 is a perspective view illustrating an outer appearance of an example linear compressor.
Figure 2:
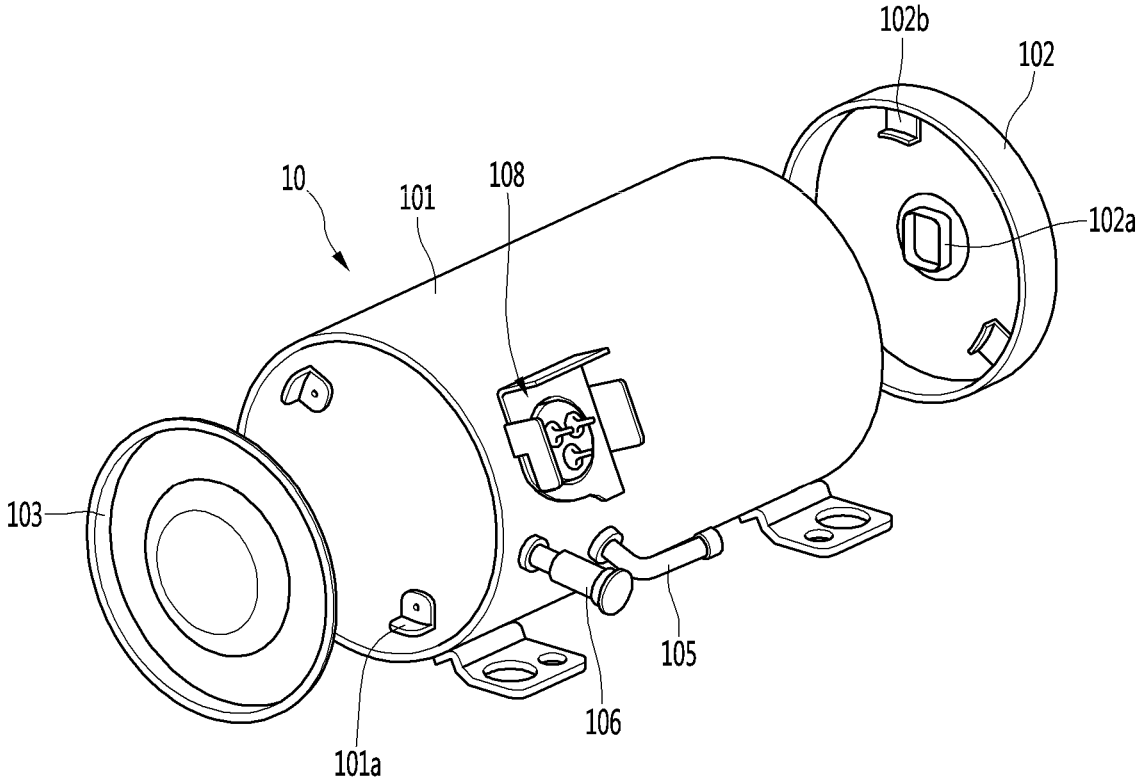
FIG. 2 is an exploded perspective view illustrating an example shell and an example shell cover of the linear compressor.

FIG. 1 is a perspective view illustrating an outer appearance of an example linear compressor, and FIG. 2 is an exploded perspective view illustrating an example shell and an example shell cover of the linear compressor.

Referring to FIGS. 1 and 2, a linear compressor 10 includes a shell 101 and shell covers 102 and 103 coupled to the shell 101. In some examples, each of the first and second shell covers 102 and 103 may be a component of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. As another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, since the linear compressor 10 has a low height, when the linear compressor 10 is installed in the machine room base of the refrigerator, a machine room may be reduced in height.

A terminal 108 may be installed on an outer surface of the shell 101. The terminal 108 may be configured to transfer external power to a motor assembly (see reference numeral 140 of FIG. 3) of the linear compressor 10. The terminal 108 may be connected to a lead line of a coil (see reference numeral 141*c* of FIG. 3). A bracket 109 is installed outside the terminal 108. The bracket 109 may include a plurality of brackets surrounding the terminal 108. The bracket 109 may protect the terminal 108 against an external impact.

Both sides of the shell 101 may be opened. The shell covers 102 and 103 may be coupled to both the opened sides of the shell 101. In detail, the shell covers 102 and 103 includes a first shell cover 102 coupled to one opened side of the shell 101 and a second shell cover 103 coupled to the other opened side of the shell 101. An inner space of the shell 101 may be sealed by the shell covers 102 and 103.

In FIG. 1, the first shell cover 102 may be disposed at a right portion of the linear compressor 10, and the second shell cover 103 may be disposed at a left portion of the linear compressor 10. For example, the first and second shell covers 102 and 103 may be disposed to face each other.

The linear compressor 10 may further include a plurality of pipes 104, 105, and 106, which are provided in the shell 101 or the shell covers 102 and 103 to suction, discharge, or inject the refrigerant. The plurality of pipes 104, 105, and 106 include a suction pipe 104 through which the refrigerant is suctioned into the linear compressor 10, a discharge pipe 105 through which the compressed refrigerant is discharged from the linear compressor 10, and a process pipe through which the refrigerant is supplemented to the linear compressor 10.

For example, the suction pipe 104 may be coupled to the first shell cover 102. The refrigerant may be suctioned into the linear compressor 10 through the suction pipe 104 in the axial direction.

The discharge pipe 105 may be coupled to an outer circumferential surface of the shell 101. The refrigerant suctioned through the suction pipe 104 may flow in the axial direction and then be compressed. In some examples, the compressed refrigerant may be discharged through the discharge pipe 105. The discharge pipe 105 may be disposed at a position that is adjacent to the second shell cover 103 rather than the first shell cover 102.

The process pipe 106 may be coupled to an outer circumferential surface of the shell 101. A worker may inject the refrigerant into the linear compressor 10 through the process pipe 106. The process pipe 106 may be coupled to the shell 101 at a height different from that of the discharge pipe 105 to avoid interference with the discharge pipe 105. The height may be a distance from the leg 50 in the vertical direction (e.g., the radial direction). Since the discharge pipe 105 and the process pipe 106 are coupled to the outer circumferential surface of the shell 101 at the heights different from each other, worker's work convenience may be improved.

At least a portion of the second shell cover 103 may be disposed adjacent to the inner circumferential surface of the shell 101, which corresponds to a point to which the process pipe 106 is coupled. For example, at least a portion of the second shell cover 103 may act as flow resistance of the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. In some examples, in this process, an oil component contained in the refrigerant may be separated. Thus, the refrigerant from which the oil component is separated may be introduced into the piston 130 to improve compression performance of the refrigerant. The oil component may be working oil existing in a cooling system.

A cover support part 102*a* is disposed on an inner surface of the first shell cover 102. A second support device 185 that will be described later may be coupled to the cover support part 102*a*. The cover support part 102*a* and the second support device 185 may include devices for supporting a main body of the linear compressor 10. Here, the main body of the compressor represents a component provided in the shell 101. For example, the main body may include a driving part that reciprocates forward and backward and a support part supporting the driving part. The driving part may include components such as the piston 130, a magnet frame 138, a permanent magnet 146, a support 137, and a suction muffler 150. In some examples, the support part may include components such as resonant springs 176*a* and 176*b*, a rear cover 170, a stator cover 149, a first support device 165, and a second support device 185.

A stopper 102*b* may be disposed on the inner surface of the first shell cover 102. The stopper 102*b* may be configured to prevent the main body of the compressor, particularly, the motor assembly 140 from being bumped by the shell 101 and thus damaged due to the vibration or the impact occurring during the transportation of the linear compressor 10. The stopper 102*b* may be disposed adjacent to the rear cover 170 that will be described later. Thus, when the linear compressor 10 is shaken, the rear cover 170 may interfere with the stopper 102*b* to prevent the impact from being transmitted to the motor assembly 140.

A spring coupling part 101*a* may be disposed on the inner circumferential surface of the shell 101. For example, the spring coupling part 101*a* may be disposed at a position that is adjacent to the second shell cover 103. The spring coupling part 101*a* may be coupled to a first support spring 166 of the first support device 165 that will be described later. Since the spring coupling part 101*a* and the first support device 165 are coupled to each other, the main body of the compressor may be stably supported inside the shell 101.

Figure 3:
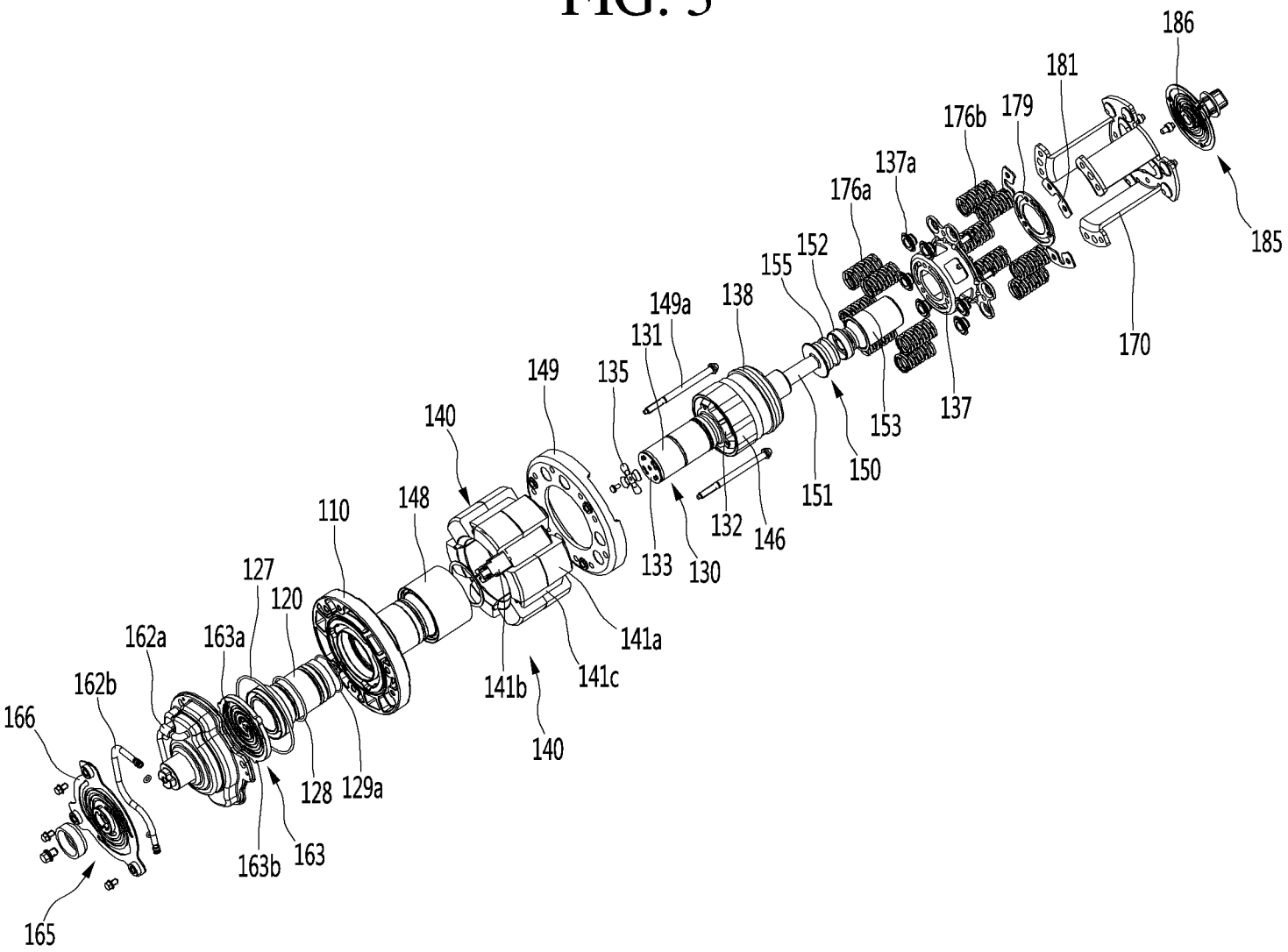
FIG. 3 is an exploded perspective view illustrating example internal components of the linear compressor.
Figure 4:
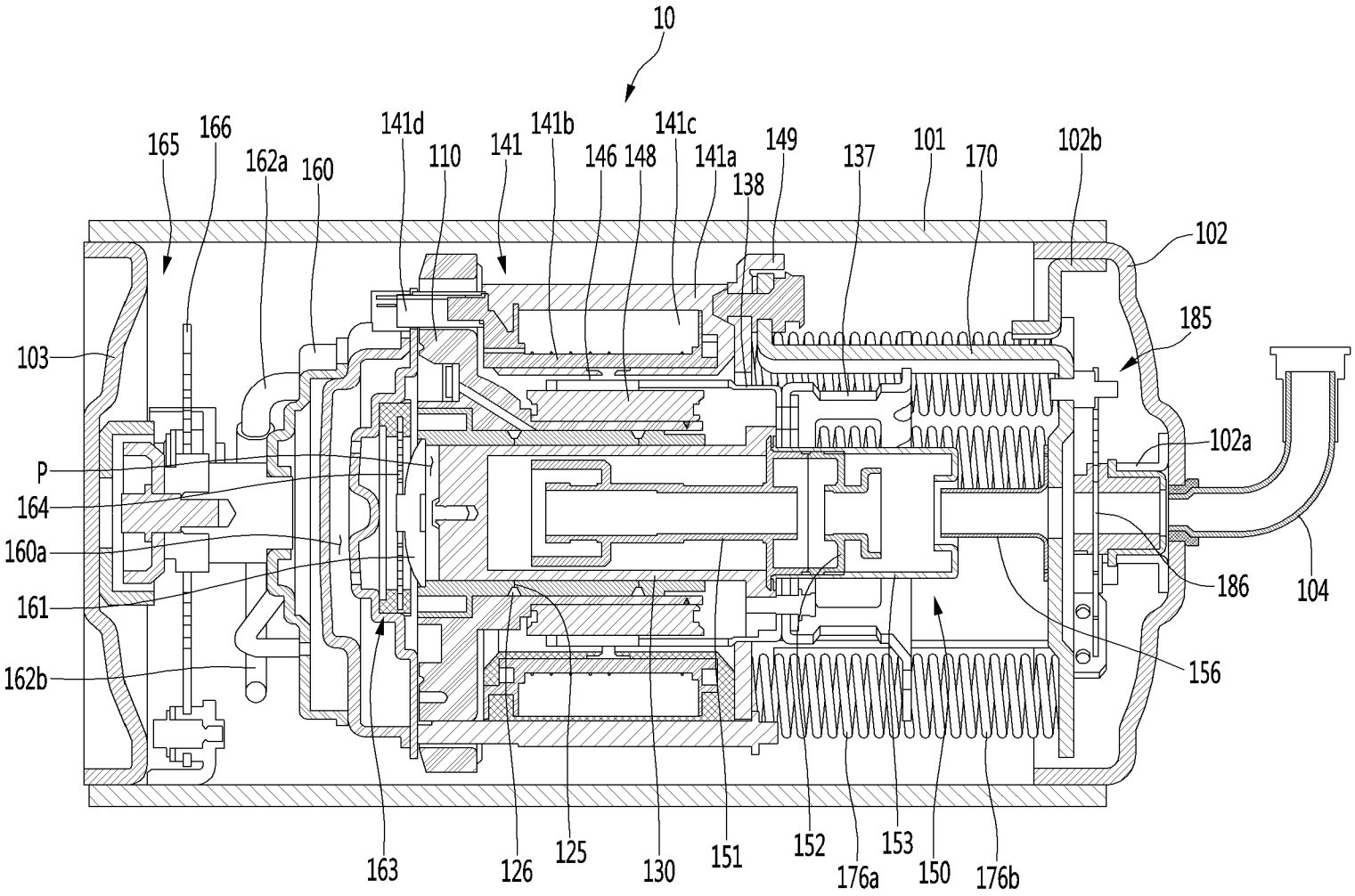
FIG. 4 is a cross-sectional view taken along line I-I' of FIG. 1.

FIG. 3 is an exploded perspective view illustrating internal components of the linear compressor, and FIG. 4 is a cross-sectional view illustrating the internal components of the linear compressor.

Referring to FIGS. 3 and 4, the linear compressor 10 includes a cylinder 120 provided in the shell 101, a piston 130 that linearly reciprocates within the cylinder 120, and a motor assembly 140 that functions as a linear motor for applying driving force to the piston 130. When the motor assembly 140 is driven, the piston 130 may linearly reciprocate in the axial direction.

The linear compressor 10 further include a suction muffler 150 coupled to the piston 130 to reduce a noise generated from the refrigerant suctioned through the suction pipe 104. The refrigerant suctioned through the suction pipe 104 flows into the piston 130 via the suction muffler 150. For example, while the refrigerant passes through the suction muffler 150, the flow noise of the refrigerant may be reduced.

The suction muffler 150 includes a plurality of mufflers 151, 152, and 153. The plurality of mufflers 151, 152, and 153 include a first muffler 151, a second muffler 152, and a third muffler 153, which are coupled to each other.

The first muffler 151 is disposed within the piston 130, and the second muffler 152 is coupled to a rear side of the first muffler 151. In some examples, the third muffler 153 accommodates the second muffler 152 therein and extends to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on a boundary on which the first muffler 151 and the second muffler 152 are coupled to each other. For example, the muffler filter 155 may have a circular shape, and an outer circumferential portion of the muffler filter 155 may be supported between the first and second mufflers 151 and 152.

The direction will be defined. The axial direction may be a direction in which the piston 130 reciprocates, for example, the horizontal direction in FIG. 4. Along the axial direction, the front direction may be a direction from the suction pipe 104 toward a compression chamber P, for example, a direction in which the refrigerant flows, and a direction opposite to the front direction may be defined as a rear direction. When the piston 130 moves forward, the compression chamber P may be compressed. The radial direction may be a direction that is perpendicular to the direction in which the piston 130 reciprocates or to the axial direction, for example, the vertical direction in FIG. 4.

The piston 130 includes a piston body 131 having an approximately cylindrical shape and a piston flange 132 extending from the piston body 131 in the radial direction. The piston body 131 may reciprocate inside the cylinder 120, and the piston flange 132 may reciprocate outside the cylinder 120.

The cylinder 120 is configured to accommodate at least a portion of the first muffler 151 and at least a portion of the piston body 131. The cylinder 120 has the compression chamber P in which the refrigerant is compressed by the piston 130. In some examples, a suction port 133 through which the refrigerant is introduced into the compression chamber P is disposed in a piston front part 131*a* defining a front surface of the piston body 131. The suction port 133 may pass trough the front surface of the piston front part 131*a*. A suction valve 135 for selectively opening the suction port 133 is disposed on a front side of the suction port 133. A coupling hole to which a predetermined coupling member is coupled is defined in an approximately central portion of the suction valve 135.

A discharge cover 160, which defines a discharge space 160*a* for the refrigerant discharged from the compression chamber P, and discharge valve assemblies 161 and 163, which are coupled to the discharge cover 160 to selectively discharge the refrigerant compressed in the compression chamber P, may be provided at a front side of the compression chamber P. The discharge space 160*a* includes a plurality of space parts that are partitioned by inner walls of the discharge cover 160. The plurality of space parts are disposed in the front and rear direction to communicate with each other.

The discharge valve assemblies 161 and 163 include a discharge valve 161 that is configured to be opened when the pressure of the compression chamber P is above a discharge pressure to introduce the refrigerant into the discharge space 160*a* of the discharge cover 160 and a spring assembly 163 disposed between the discharge valve 161 and the discharge cover 160 to provide elastic force in the axial direction.

The spring assembly 163 includes a valve spring 163*a* and a spring support part 163*b* for supporting the valve spring 163*a* to the discharge cover 160. For example, the valve spring 163*a* may include a plate spring. In some examples, the spring support part 163*b* may be integrally injection-molded to the valve spring 163*a* through an injection-molding process.

The discharge valve 161 is coupled to the valve spring 163*a*, and a rear portion or a rear surface of the discharge valve 161 is disposed to be supported on the front surface of the cylinder 120. When the discharge valve 161 is supported on the front surface of the cylinder 120, the compression chamber P may be maintained in the sealed state. When the discharge valve 161 is spaced apart from the front surface of the cylinder 120, the compression chamber P may be opened to allow the refrigerant in the compression chamber P to be discharged.

The compression chamber P may be a space defined between the suction valve 135 and the discharge valve 161. In some examples, the suction valve 135 may be disposed on one side of the compression chamber P, and the discharge valve 161 may be disposed on the other side of the compression chamber P, for example, an opposite side of the suction valve 135.

While the piston 130 is linearly reciprocated within the cylinder 120, when the pressure of the compression chamber P is below the discharge pressure and a suction pressure, the discharge valve 161 may be closed, and the suction valve 135 may be opened to suction the refrigerant into the compression chamber P. When the pressure of the compression chamber P is above the suction pressure, the suction valve 135 may compress the refrigerant of the compression chamber P in a state in which the suction valve 135 is closed.

When the pressure of the compression chamber P is above the discharge pressure, the valve spring 163*a* may be deformed forward to open the discharge valve 161. Here, the refrigerant may be discharged from the compression chamber P into the discharge space 160*a* of the discharge cover 160. When the discharge of the refrigerant is completed, the valve spring 163*a* may provide restoring force to the discharge valve 161 to close the discharge valve 161.

The linear compressor 10 may further include a cover pipe 162*a* coupled to the discharge cover 160 to discharge the refrigerant flowing through the discharge space 160*a* of the discharge cover 160. For example, the cover pipe 162*a* may be made of a metal material.

In some examples, the linear compressor 10 may further include a loop pipe 162*b* coupled to the cover pipe 162*a* to transfer the refrigerant flowing through the cover pipe 162*a* to the discharge pipe 105. The loop pipe 162*b* may have one side coupled to the cover pipe 162*a* and the other side coupled to the discharge pipe 105. The loop pipe 162*b* may be made of a flexible material and have a relatively long length. In some examples, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 may further include a frame 110. The frame 110 may be configured to fix the cylinder 120. For example, the cylinder 120 may be press-fitted into the frame 110. Each of the cylinder 120 and the frame 110 may be made of aluminum or an aluminum alloy material. The frame 110 is disposed to surround the cylinder 120. That is, the cylinder 120 may be disposed to be accommodated into the frame 110. In some examples, the discharge cover 160 may be coupled to a front surface of the frame 110 by using a coupling member.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by mutual electromagnetic force between the outer stator 141 and the inner stator 148. In some examples, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148. In detail, in the cross-sectional view of FIG. 4, the magnet frame 138 may be coupled to the piston flange 132 to extend in an outer radial direction and then be bent forward. The permanent magnet 146 may be installed on a front portion of the magnet frame 138. When the permanent magnet 146 reciprocates, the piston 130 may reciprocate together with the permanent magnet 146 in the axial direction.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* that is wound in a circumferential direction of the bobbin 141*b*. The coil winding bodies 141*b*, 141*c*, and 141*d* further include a terminal part 141*d* that guides a power line connected to the coil 141*c* so that the power line is led out or exposed to the outside of the outer stator 141. The terminal part 141*d* may be disposed to be inserted into a terminal insertion part of the frame 110.

The stator core 141*a* may include a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. That is, the outer stator 141 may have one side supported by the frame 110 and the other side supported by the stator cover 149. The linear compressor 10 may further include a cover coupling member 149*a* for coupling the stator cover 149 to the frame 110. The cover coupling member 149*a* may pass through the stator cover 149 to extend forward to the frame 110 and then be coupled to a first coupling hole of the frame 110.

The inner stator 148 is fixed to an outer circumference of the frame 110. In some examples, in the inner stator 148, the plurality of laminations are laminated outside the frame 110 in the circumferential direction.

The linear compressor 10 may further include a support 137 for supporting the piston 130. The support 137 may be coupled to a rear portion of the piston 130, and the muffler 150 may be disposed to pass through the inside of the support 137. The piston flange 132, the magnet frame 138, and the support 137 may be coupled to each other by using a coupling member. A balance weight 179 may be coupled to the support 137. A weight of the balance weight 179 may be determined based on a driving frequency range of the compressor body.

The linear compressor 10 may further include a rear cover 170 coupled to the stator cover 149 to extend backward and supported by the second support device 185. In detail, the rear cover 170 includes three support legs, and the three support legs may be coupled to a rear surface of the stator cover 149. A spacer 181 may be disposed between the three support legs and the rear surface of the stator cover 149. A distance from the stator cover 149 to a rear end of the rear cover 170 may be determined by adjusting a thickness of the spacer 181. In some examples, the rear cover 170 may be spring-supported by the support 137.

The linear compressor 10 may further include an inflow guide part 156 coupled to the rear cover 170 to guide an inflow of the refrigerant into the suction muffler 150. At least a portion of the inflow guide part 156 may be inserted into the suction muffler 150.

The linear compressor 10 may further include a plurality of resonant springs 176*a* and 176*b* that are adjusted in natural frequency to allow the piston 130 to perform a resonant motion. The plurality of resonant springs 176*a* and 176*b* include a first resonant spring 176*a* supported between the support 137 and the stator cover 149 and a second resonant spring 176*b* supported between the support 137 and the rear cover 170. The driving part that reciprocates within the linear compressor 10 may stably move by the action of the plurality of resonant springs 176*a* and 176*b* to reduce the vibration or noise due to the movement of the driving part. In some examples, the support 137 includes a first spring support part 137*a* coupled to the first resonant spring 176*a*.

The linear compressor 10 includes the frame 110 and a plurality of sealing members 127, 128, and 129*a* for increasing coupling force between the peripheral components around the frame 110. In detail, the plurality of sealing members 127, 128, and 129*a* include a first sealing member 127 disposed at a portion at which the frame 110 and the discharge cover 160 are coupled to each other. The first sealing member 127 may be disposed on a second installation groove (see reference numeral 116*b* of FIG. 6) of the frame 110.

The plurality of sealing members 128, 128, and 129*a* further include a second sealing member 128 disposed at a portion at which the frame 110 and the cylinder 120 are coupled to each other. The second sealing member 128 may be disposed on a first installation groove (see reference numeral 116*a* of FIG. 6) of the frame 110.

The plurality of sealing members 127, 128, and 129*a* further include a third sealing member 129*a* disposed between the cylinder 120 and the frame 110. The third sealing member 129*a* may be disposed on a cylinder groove defined in the rear portion of the cylinder 120. The third sealing member 129*a* may prevent the refrigerant within a gas pocket defined between an inner circumferential surface of the frame 110 and an outer circumferential surface of the cylinder 120 from leaking to the outside to increase coupling force between the frame 110 and the cylinder 120. Each of the first and second sealing members 127, 128, and 129*a* may have a ring shape.

The linear compressor 10 may further include a first support device 165 coupled to the discharge cover 160 to support one side of the main body of the compressor 10. The first support device 165 may be disposed adjacent to the second shell cover 103 to elastically support the main body of the compressor 10. In detail, the first support device 165 includes a first support spring 166. The first support spring 166 may be coupled to the spring coupling part 101*a*.

The linear compressor 10 may further include a second support device 185 coupled to the rear cover 170 to support the other side of the main body of the compressor 10. The second support device 185 may be coupled to the first shell cover 102 to elastically support the main body of the compressor 10. In detail, the second support device 185 includes a second support spring 186. The second support spring 186 may be coupled to the cover support part 102*a*.

Figure 5:
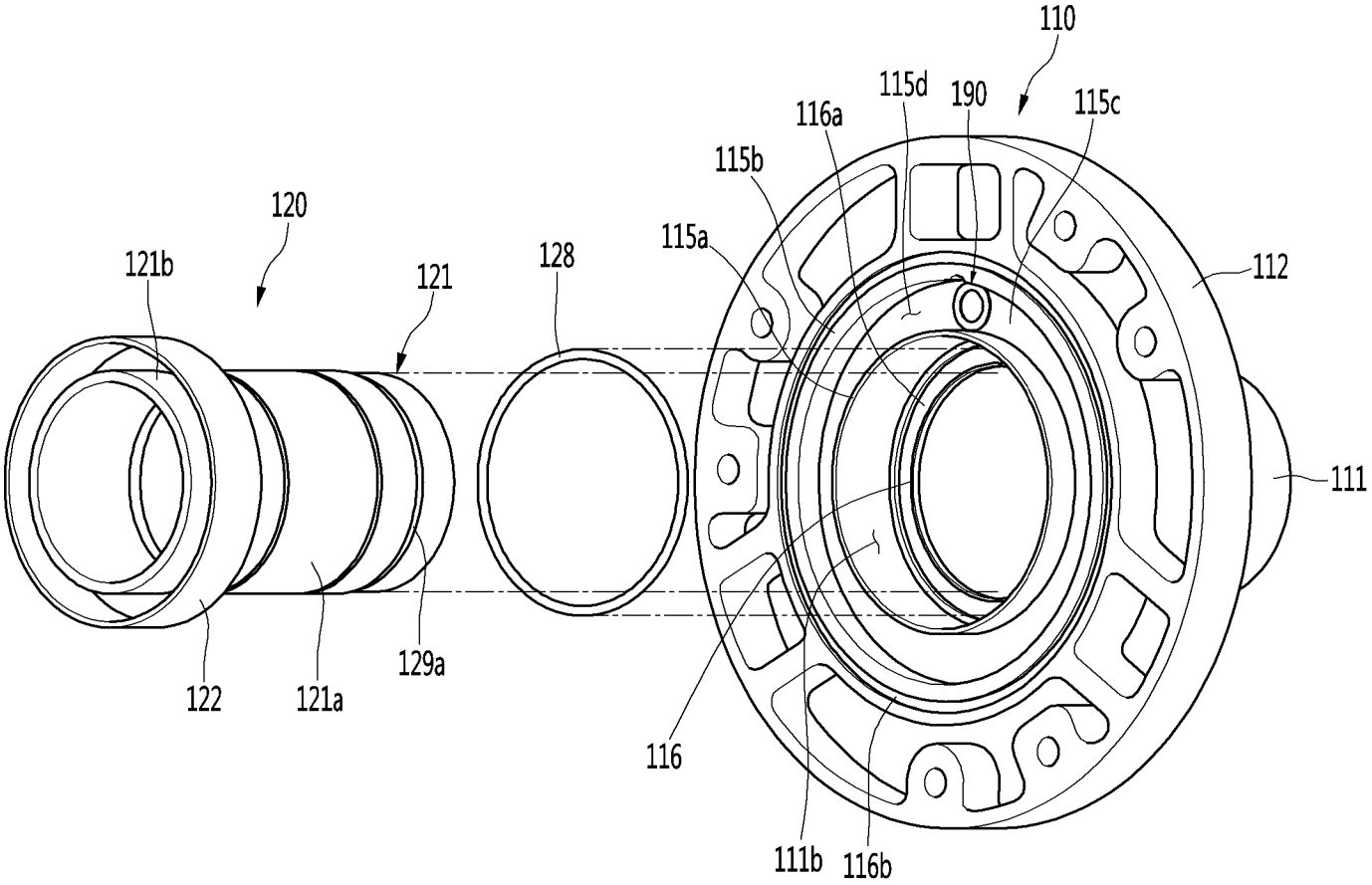
FIG. 5 is an exploded perspective view of an example frame and an example cylinder.
Figure 6:
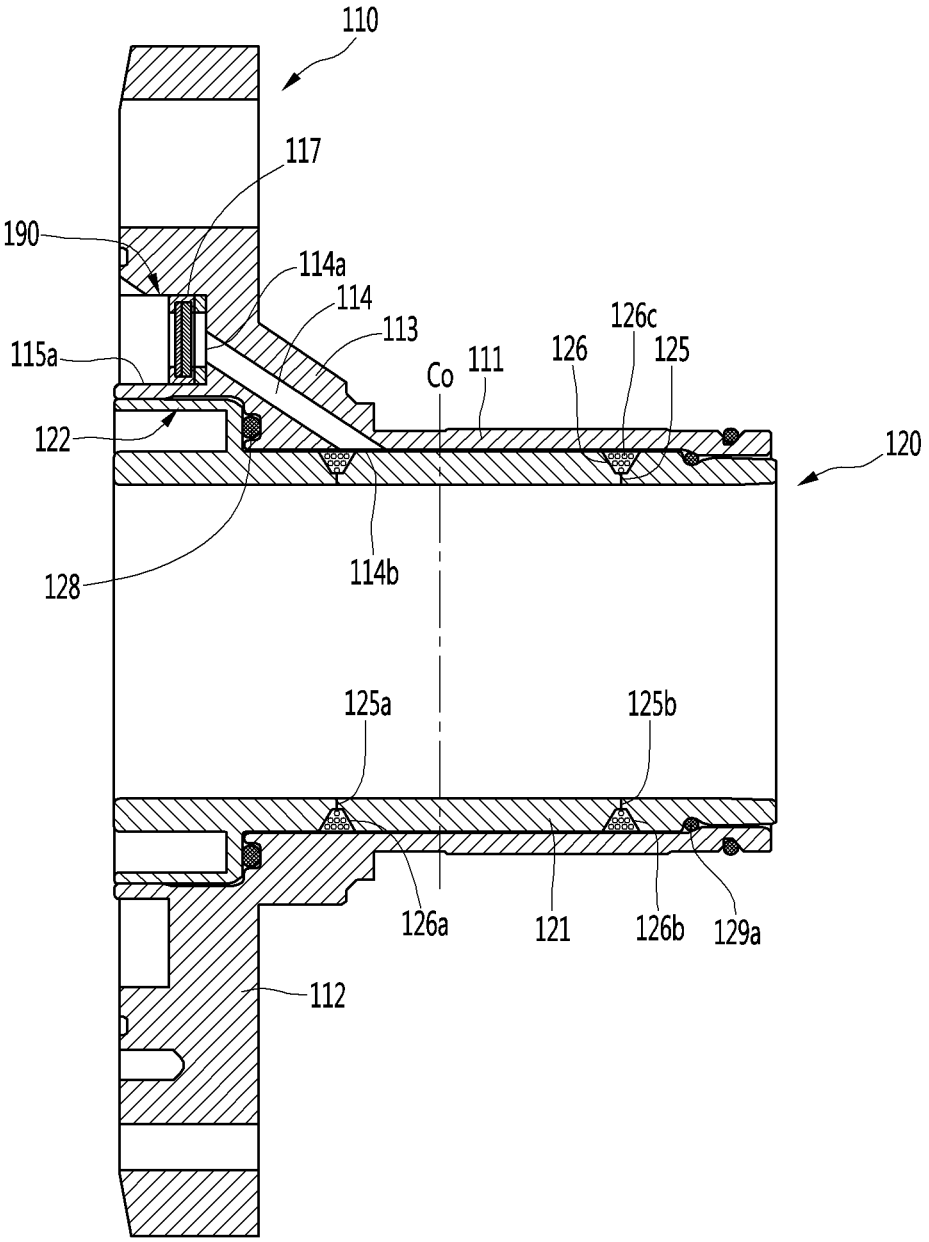
FIG. 6 is a cross-sectional view illustrating a state in which the frame and the cylinder are coupled to each other.

FIG. 5 is an exploded perspective view of the frame and the cylinder, and FIG. 6 is a cross-sectional view illustrating a state in which the frame and the cylinder are coupled to each other.

Referring to FIGS. 5 and 6, the cylinder 120 may be coupled to the frame 110. For example, the cylinder 120 may be disposed to be inserted into the frame 110.

The frame 110 includes a frame body 111 extending in the axial direction and a frame flange 112 extending outward from the frame body 111 in the radial direction.

The frame body 111 includes a main body accommodation part having a cylindrical shape with a central axis in the axial direction and accommodating the cylinder body 121 therein. The frame flange 112 includes a first wall 115*a* having a ring shape and coupled to the cylinder flange 122, a second wall 115*b* having a ring shape and disposed to surround the first wall 115*a*, and a third wall 115*c* connecting a rear end of the first wall 115*a* to a rear end of the second wall 115*b*. Each of the first wall 115*a* and the second wall 115*b* may extend in the axial direction, and the third wall 115*c* may extend in the radial direction.

Thus, a frame space part 115*d* may be defined by the first to third walls 115*a*, 115*b*, and 115*c*. The frame space part 115*d* is recessed backward from a front end of the frame flange 112 to form a portion of the discharge passage through which the refrigerant discharged through the discharge valve 161 flows.

A second installation groove 116*b* defined in a front end of the second wall 115*b* and in which the first sealing member 127 is installed is defined in the frame flange 112.

A flange accommodation part 111*b*, into which at least a portion of the cylinder 120 (e.g., the cylinder flange 122) is inserted, may be defined in an inner space of the first wall 115*a*. For example, the flange accommodation part 111*b* may have an inner diameter equal to or slightly less than an outer diameter of the cylinder flange 122. When the cylinder 120 is press-fitted into the frame 110, the cylinder flange 122 may interfere with the first wall 115*a*. In this process, the cylinder flange 122 may be deformed.

The frame flange 112 may further include a sealing member seating part 116 extending inward from a rear end of the first wall 115*a* in the radial direction. A first installation groove 116*a* into which the second sealing member 128 is inserted is defined in the sealing member seating part 116.

The frame 110 may further include a frame extension part 113 inclinedly extending from the frame flange 112 to the frame body 111. An outer surface of the frame extension part 113 may extend at a second preset angle with respect to the outer circumferential surface of the frame body 111, for example, in the axial direction. For example, the second preset angle may be greater than about 0° and less than about 90°.

A gas hole 114 for guiding the refrigerant discharged from the discharge valve 161 to a gas inflow part 126 of the cylinder 120 is defined in the frame extension part 113. The gas hole 114 may pass through the inside of the frame extension part 113. In detail, the gas hole 114 may extend from the frame flange 112 up to the frame body 111 via the frame extension part 113.

The extension direction of the gas hole 114 may correspond to the extension direction of the frame extension part 113 to form the second preset angle with respect to the inner circumferential surface of the frame body 111, for example, in the axial direction.

A discharge filter 190 for filtering foreign substances from the refrigerant introduced into the gas hole 114 is disposed on an inlet port 114*a* of the gas hole 114. The discharge filter 190 may be installed on the third wall 115*c*.

In detail, the discharge filter 190 may be installed on a filter groove 117 defined in the frame flange 112. The filter groove 117 may be recessed backward from the third wall 115*c* and have a shape corresponding to that of the discharge filter 190. In some examples, an outlet part 114*b* of the gas hole 114 may communicate with the inner circumferential surface of the frame body 111.

That is, the cylinder 120 may be coupled to the inside of the frame 110. For example, the cylinder 120 may be coupled to the frame 110 through a press-fitting process.

The cylinder 120 includes a cylinder body 121 extending in the axial direction and a cylinder flange 122 disposed outside a front portion of the cylinder body 121. The cylinder body 121 has a cylindrical shape with a central axis in the axial direction and is inserted into the frame body 111. Thus, an outer circumferential surface of the cylinder body 121 may be disposed to face an inner circumferential surface of the frame body 111.

A gas inflow part 126 into which the gas refrigerant flowing through the gas hole 114 is introduced is provided in the cylinder body 121.

The linear compressor 10 may further include a gas pocket defined between the inner circumferential surface of the frame 110 and the outer circumferential surface of the cylinder 120 so that the gas used as the bearing flows. A cooling gas passage from the outlet part 114*b* of the gas hole 114 to the gas inflow part 126 may define at least a portion of the gas pocket. In some examples, the gas inflow part 126 may be disposed at an inlet side of a cylinder nozzle 125 that will be described later.

In detail, the gas inflow part 126 may be recessed inward from the outer circumferential surface of the cylinder body 121 in the radial direction. In some examples, the gas inflow part 126 may have a circular shape along the outer circumferential surface of the cylinder body 121 with respect to the central axis in the axial direction.

The gas inflow part 126 may be provided in plurality. For example, two gas inflow parts 126 may be provided. A first gas inflow part 126*a* of the two gas inflow parts 126 is disposed on a front portion of the cylinder body 121, for example, at a position that is close to the discharge valve 161, and a second gas inflow part 126*b* is disposed on a rear portion of the cylinder body 121, for example, at a position that is close to a compressor suction side of the refrigerant. That is, the first gas inflow part 126*a* may be disposed at a front side with respect to a central portion Co in a front and rear direction of the cylinder body 121, and the second gas inflow part 126*b* may be disposed at a rear side. In some examples, a first nozzle part 125*a* connected to the first gas inflow part 126*a* may be disposed at a front side with respect to the central portion Co, and a second nozzle part 125*b* connected to the second gas inflow part 126*b* may be disposed at a rear side with respect to the central portion Co.

An internal pressure of the cylinder 120 is relatively high at a position that is close to the discharge side of the refrigerant, for example, the inside of the first gas inflow part 126*a*. That is, since the pressure in the compression chamber P is substantially the same as that of a refrigerant introduced through the first gas inflow parts 126*a* and 126*b*, an inflow of the refrigerant, which is introduced from the first gas inflow parts 126*a*, to a front side, for example, a flow of the refrigerant to the compression chamber P, may be restricted. The refrigerant may have a tendency to flow toward a rear side of the cylinder 120 having a relatively low pressure.

The refrigerant compressed in the compression chamber P may be introduced into the space between the outer circumferential surface of the front portion of the piston 130 and the inner circumferential surface of the front portion of the cylinder 120 to act as a gas bearing at the front side of the piston 130. However, when the force of the compressed refrigerant is excessively applied to the space between the outer circumferential surface of the piston 130 and the inner circumferential surface of the cylinder 120, the gap between the piston 130 and the cylinder 120 may be non-uniform to cause friction between the piston 130 and the cylinder 120. In this implementation, to prevent this phenomenon from occurring, a refrigerant collection part 200 is provided in the piston 130. An explanation thereof will be described later.

A cylinder filter member 126*c* may be installed on the gas inflow part 126. The cylinder filter member 126*c* may prevent a foreign substance having a predetermined size or more from being introduced into the cylinder 120 and perform a function for absorbing oil components contained in the refrigerant. Here, the predetermined size may be about 1 μm. The cylinder filter member 126*c* includes a thread that is wound around the gas inflow part 126. In detail, the thread may be formed of a polyethylene terephthalate (PET) material and have a predetermined thickness or diameter.

The cylinder body 121 may further include the cylinder nozzle 125 extending inward from the gas inflow part 126 in the radial direction. The cylinder nozzle 125 may extend up to the inner circumferential surface of the cylinder body 121.

The cylinder nozzle 125 includes a first nozzle part 125*a* extending from the first gas inflow part 126*a* to the inner circumferential surface of the cylinder body 121 and a second nozzle part 125*b* extending from the second gas inflow part 126*b* to the inner circumferential surface of the cylinder body 121.

The refrigerant that is filtered by the cylinder filter member 126*c* while passing through the first gas inflow parts 126*a* and 126*b* is introduced into a space between an inner circumferential surface of the first cylinder body 121 and an outer circumferential surface of the piston body 131 through the first and nozzle parts 125*a* and 125*b*. The gas refrigerant flowing to the outer circumferential surface of the piston body 131 through the first and second nozzle parts 125*a* and 125*b* may provide levitation force to the piston 130 to perform a function as the gas bearing with respect to the piston 130.

The cylinder flange 122 includes a first flange extending outward from the cylinder body 121 in the radial direction and a second flange extending forward from the first flange. In detail, the cylinder flange 122 may be press-fitted into an inner surface of the first wall 115*a* of the frame 110.

Figure 7:
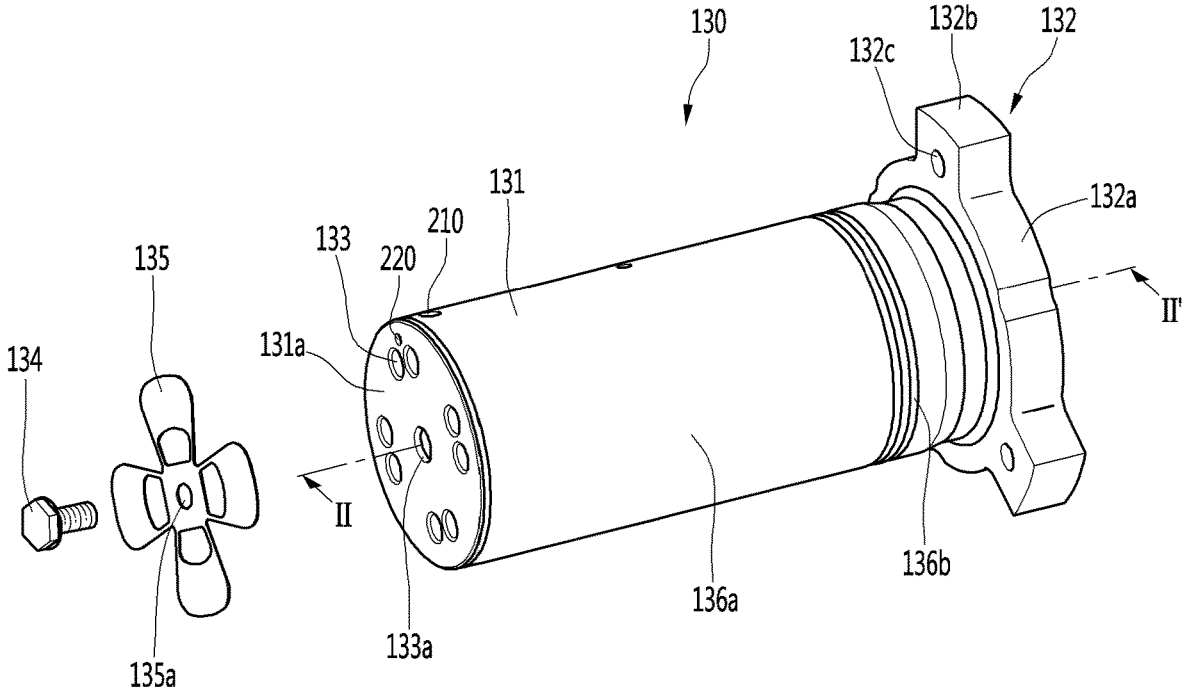
FIG. 7 is an exploded perspective view of an example piston and an example suction valve.
Figure 8:
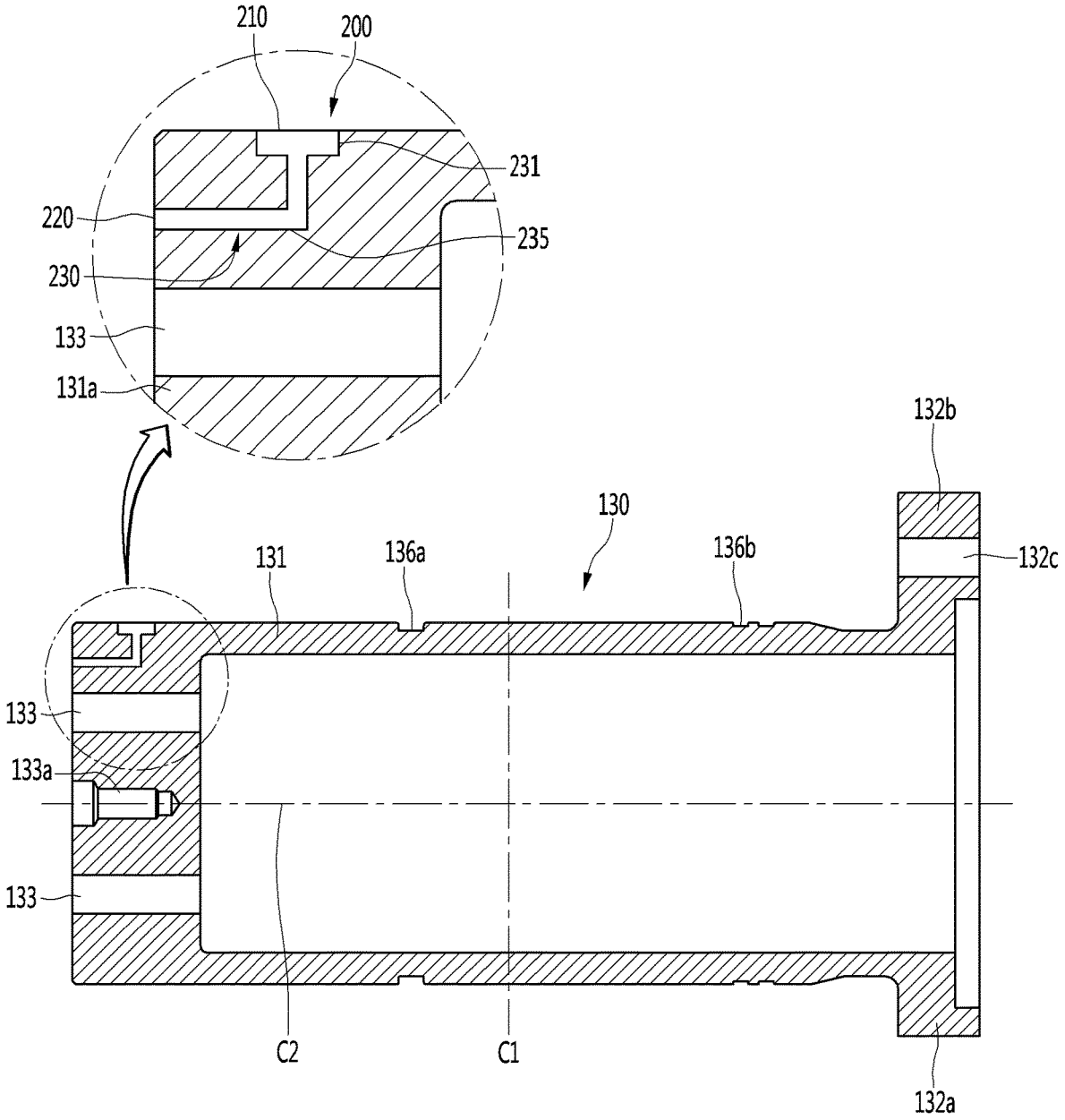
FIG. 8 is a cross-sectional view taken along line II-II' of FIG. 7.

FIG. 7 is an exploded perspective view of the piston and the suction valve, and FIG. 8 is a cross-sectional view taken along line II-II' of FIG. 7.

Referring to FIGS. 7 and 8, the linear compressor 10 includes the piston 130 reciprocating in the axial direction, for example, the front and rear direction within the cylinder 120 and the suction valve 135 coupled to a front side of the piston 130.

The linear compressor 10 may further include a valve coupling member 134 for coupling the suction valve 135 to a coupling hole 133*a* of the piston 130. The coupling hole 133*a* may be defined in an approximately central portion of a front end surface of the piston 130. The valve coupling member 134 may pass through a valve coupling hole 135*a* of the suction valve 135 and be coupled to the coupling hole 133*a*.

The piston 130 includes a piston body 131 having an approximately cylindrical shape and extending in the front and rear direction and a piston flange 132 extending outward from the piston body 131 in the radial direction.

The piston body 131 includes a piston front part 131*a* in which the coupling hole 133*a* is defined. The piston front part 131*a* defines a front portion of the piston 130. A suction port 133 that is selectively covered by the suction valve 135 is defined in the piston front part 131*a*. In some examples, the suction valve 135 may be coupled to a front surface of the piston front part 131*a*.

The suction port 133 is provided in plurality, and the plurality of suction ports 133 are defined outside the coupling hole 133*a* in a circumferential direction. For example, the plurality of suction ports 133 may be defined to surround the coupling hole 133*a*.

A rear portion of the piston body 131 may be opened to suction the refrigerant. At least a portion of the suction muffler 150 (e.g., the first muffler 151) may be inserted into the piston body 131 through the opened rear portion of the piston body 131.

A first piston groove 136*a* is defined in the outer circumferential surface of the piston body 131. The first piston groove 136*a* may be defined in a front side with respect to a central line C1 in a radial direction of the piston body 131. The first piston groove 136*a* may be configured to guide a smooth flow of the refrigerant gas introduced through the cylinder nozzle 125 and preventing the pressure loss from occurring. The first piston groove 136*a* may be defined along a circumference of the outer circumferential surface of the piston body 131.

A second piston groove 136*b* is defined in the outer circumferential surface of the piston body 131. The second piston groove 136*b* may be defined in a rear side with respect to the central line C1 in the radial direction of the piston body 131. The second piston groove 136*b* may be a discharge guide groove configured to guide the discharge of the refrigerant gas used for levitating the piston 130 to the outside of the cylinder 120. Since the refrigerant gas is discharged to the outside of the cylinder 120 through the second piston groove 136*b*, the refrigerant gas used as the gas bearing may be prevented from being introduced again into the compression chamber P via the front side of the piston body 131.

The second piston groove 136*b* may be spaced apart form the first piston groove 136*a* and defined along the circumference of the outer circumferential surface of the piston body 131. In some examples, the second piston groove 136*b* may be provided in plurality.

The piston flange 132 includes a flange body 132*a* extending outward from the rear portion of the piston body 131 in the radial direction and a piston coupling part 132*b* further extending outward from the flange body 132*a* in the radial direction.

The piston coupling part 132*b* includes a piston coupling hole 132*c* to which a predetermined coupling member is coupled. The coupling member may pass through the piston coupling hole 132*c* and be coupled to the magnet frame 138 and the support 137. In some examples, the piston coupling part 132*b* may be provided in plurality, and the plurality of piston coupling parts 132*b* may be spaced apart from each other and disposed on an outer circumferential surface of the flange body 132*a*.

The second piston groove 136*b* may be disposed between the first piston groove 136*a* and the piston flange 132.

The piston 130 may further include the refrigerant collection part 200 that collects or stores the refrigerant of the compression chamber P. The refrigerant collection part 200 may communicate with the compression chamber P. In detail, a gap part (see reference numeral 250 of FIG. 9) is defined between the outer circumferential surface of the piston body 131 and the inner circumferential surface of the cylinder body 121. The refrigerant may be introduced into the gap part 250 through the gas inflow part 126 and the cylinder nozzle 125, and the introduced refrigerant may act as the gas bearing.

The compression chamber P may communicate with the gap part 250. That is, the compression chamber P may not be sealed by the gap part 250, and the refrigerant existing in the compression chamber P may be introduced into the gap part 250. Due to the introduction of the refrigerant, the front portion of the piston 130 may have the levitation force with respect to the inner circumferential surface of the cylinder 120, and the refrigerant may act as the gas bearing.

However, when an amount of refrigerant introduced into the gap part 250 is non-uniform over the outer circumferential surface of the piston 130, the piston 130 may be lean to one side to cause the friction between the piston 130 and the cylinder 120. For example, the piston 130 and the cylinder 120 may be not coaxial with each other during the operation of the compressor, and the size of the gap part 250 may be not uniform over the outer circumferential surface of the piston 130. In this case, a relatively large amount of refrigerant may be introduced into the gap part 250 having a relatively large size.

As a result, force may act from the gap part 250 having a relatively large size to the gap part 250 having a relatively small size with respect to the piston 130, and thus, the piston 130 may come into contact with the inner circumferential surface of the cylinder 120. Thus, an object of this implementation is to store at least a portion of the refrigerant introduced into the gap part 250 from the compression chamber P to reduce the force acting on the piston 130.

The refrigerant collection part 200 may be disposed in the piston front part 131*a*. In detail, the refrigerant collection part 200 may include an inflow part 210 communicating with the gap part 250 to guide the refrigerant flowing through the gap part 250 to the inside of the refrigerant collection part 200. The inflow part 210 may be disposed in the outer circumferential surface of the piston front part 131*a*.

The refrigerant collection part 200 may include a discharge part 220 through which the refrigerant collected into or stored in the refrigerant collection part 200 is discharged toward a side of the compression chamber P. The discharge part 220 may be disposed in the front surface of the piston front part 131*a*. That is, the discharge part 220 may be provided in the front surface of the piston body 131 in which the suction port 133 is provided. For example, the discharge part 220 may be disposed outside the suction port 133 in the radial direction with respect to a central line C2 in the axial direction of the piston 130.

The discharge part 220 may be selectively opened and closed by the suction valve 135. After the suction of the refrigerant into the compression chamber P is completed, when the compression in the compression chamber P is performed, the suction valve 135 may close the suction port 133. Here, the suction valve 135 may close the discharge part 220 together with the suction port 133. Thus, the discharge of the refrigerant from the refrigerant collection part 200 may be restricted (see FIG. 9).

When the suction valve 135 is opened to suction the refrigerant into the compression chamber P through the suction port 133, the discharge part 220 is opened. That is, the suction valve 135 may operate to open the suction port 133 and the discharge part 220 together (see FIG. 10).

The refrigerant collection part 200 may further include a connection passage 230 connecting the inflow part 210 to the discharge part 220. The connection passage 230 may extend from the inflow part 210 to the discharge part 220. The refrigerant collection part 220 may pass from the outer circumferential surface of the piston body 131 to the front surface of the piston body 131 due to the inflow part 210, the connection passage 230, and the discharge part 220.

The connection passage 230 includes a first passage part 231 connected to the first inflow part 210 and a second passage part 235 extending from the first passage part 231 to the discharge part 220. The first and second passage parts 231 and 235 are connected to each other.

The first passage part 231 is recessed from the outer circumferential surface of the piston body 131. In some examples, the second passage part 235 may have a shape that is bent forward from the first passage part 231. Thus, the refrigerant of the connection passage 230 may be easily guided to the front surface of the piston 130.

The first passage part 231 may have a cross-sectional area less than that of the second passage part 235. That is, since the first passage part 231 has the relatively large cross-sectional area, the refrigerant flowing through the gap part 250 may be easily introduced into the first passage part 231. In some examples, since the second passage part 235 has a relatively small cross-sectional area, when the suction valve 135 is opened, the refrigerant stored in the connection passage 230 may be easily discharged to the discharge part 220 through the second passage part 235.

The compression chamber P, the gap part 250, and the refrigerant collection part 200 may form a circulation passage through which the refrigerant circulates. In some examples, the suction valve 135 may be configured to selectively close the circulation passage. Thus, the storage of the refrigerant into the refrigerant collection part 200 and the discharge of the refrigerant from the refrigerant collection part 200 may be repeatedly performed.

Figure 9:
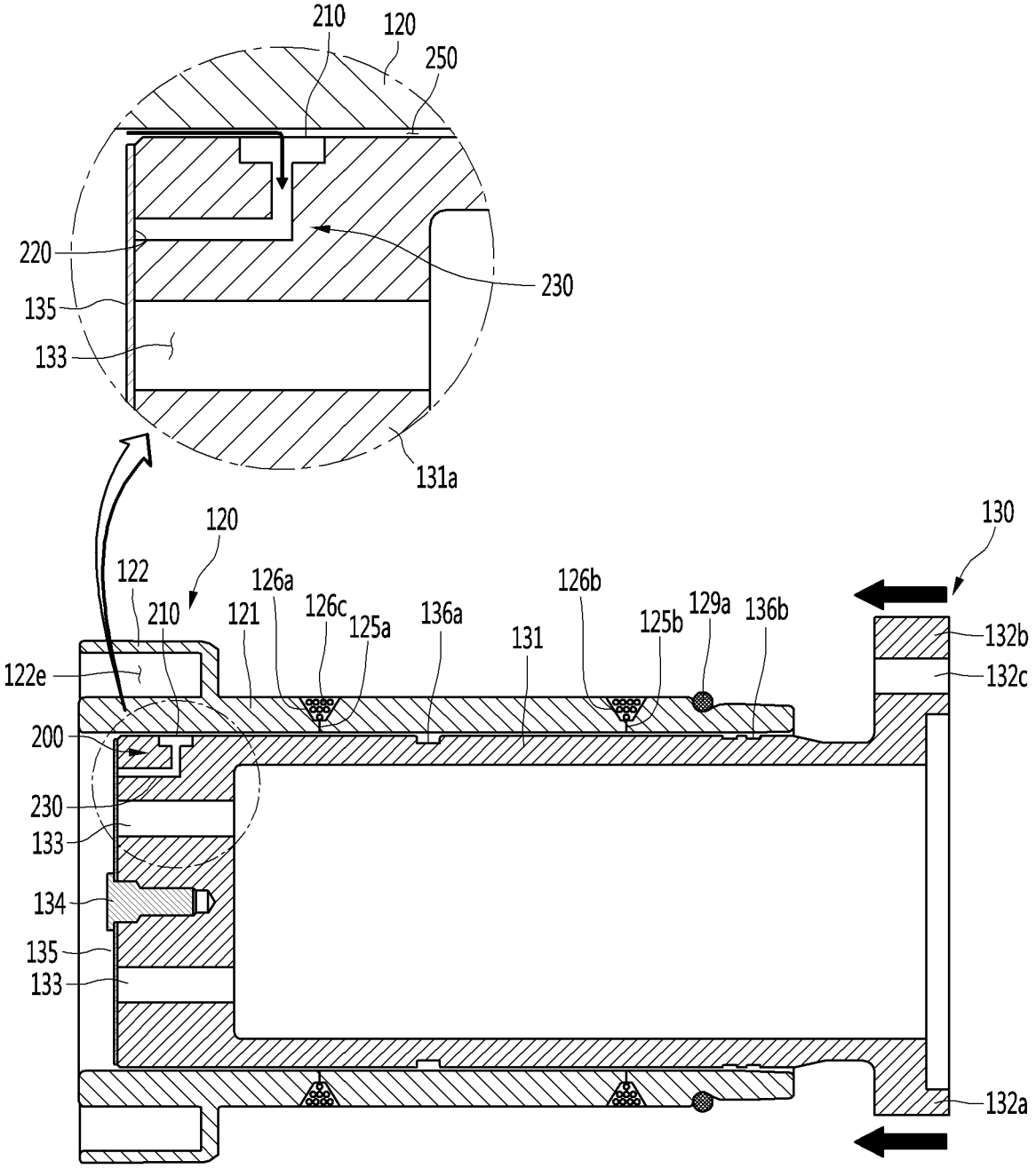
FIG. 9 is a cross-sectional view illustrating a state in which the piston moves forward within the cylinder.
Figure 10:
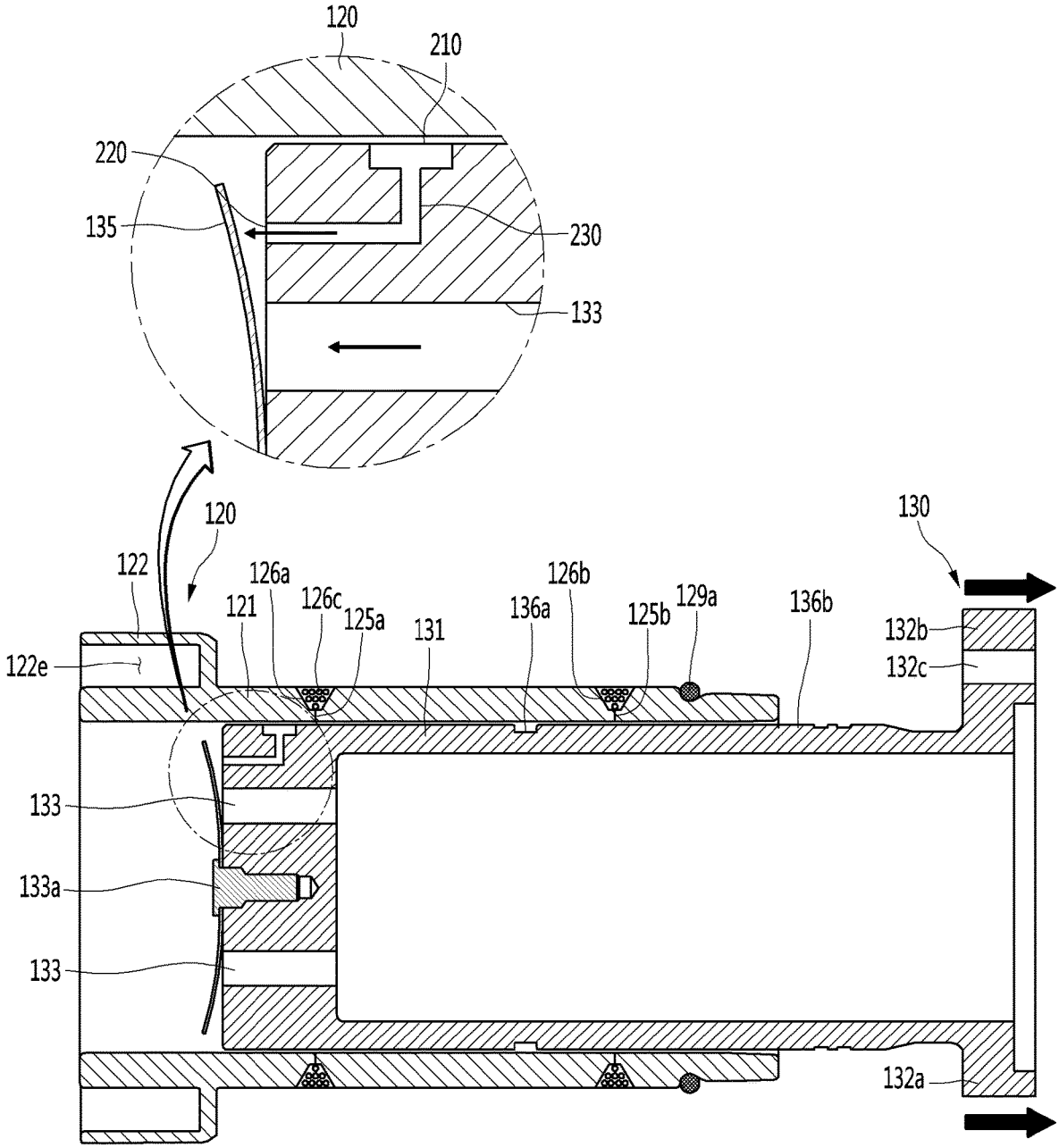
FIG. 10 is a cross-sectional view illustrating a state in which the piston moves backward within the cylinder.

FIG. 9 is a cross-sectional view illustrating a state in which the piston moves forward within the cylinder, and FIG. 10 is a cross-sectional view illustrating a state in which the piston moves backward within the cylinder.

Referring to FIG. 9, when the piston 130 moves forward, the refrigerant in the compression chamber P may be compressed, and at least a portion of the compressed refrigerant may flow through the gap part 250 and then be stored in the refrigerant collection part 200. Here, since the suction valve 135 is in a state of closing the suction port 133 and the discharge part 220, the discharge of the refrigerant stored in the refrigerant collection part 200 (e.g., the connection passage 230) to the compression chamber P through the discharge part 220 may be restricted.

According to the above-described process, since the high-pressure refrigerant flowing through the gap part 250 is collected into the refrigerant collection part 200, the force generated by the high-pressure refrigerant may be reduced. Thus, possibility of the friction between the piston 130 and the cylinder 120 may be reduced to improve the compression efficiency.

Referring to FIG. 10, when the piston 130 moves backward, the compression chamber P may increase in volume, and thus, the low-pressure refrigerant may be suctioned into the compression chamber P through the suction port 133. Here, since the pressure of the suction port 133 is greater than that of the compression chamber P, the suction valve 135 may be opened.

Since the suction valve 135 is opened, the discharge part 220 of the refrigerant collection part 200 may be opened. Thus, the refrigerant stored in the refrigerant collection part 200 may be discharged to the discharge part 220 via the connection passage 230. In some examples, the refrigerant discharged from the discharge part 220 may be suctioned into the compression chamber P and then compressed together with the refrigerant suctioned through the suction port 133.

As described above, since the refrigerant stored in the refrigerant collection part 200 is discharged while the refrigerant is suctioned into the compression chamber P, the refrigerant compressed in the next compression cycle may be stored in the refrigerant collection part 200 via the gap part 250 as described with reference to FIG. 9. If the refrigerant stored in the refrigerant collection part 200 is not discharged, the refrigerant compressed in the next compression cycle may not flow to the refrigerant collection part 200, but flow to the rear side of the piston 130. In this case, the action of the gas bearing at the front portion of the piston 130 may be reduced to reduce the levitation force of the piston 130. As a result, the friction between the front portion of the piston 130 and the cylinder 120 may occur.

In this implementation, since the storage and the discharge of the high-pressure refrigerant into/from the refrigerant collection part 200 are repeatedly performed, the above-described limitation may be prevented.

Figure 11:
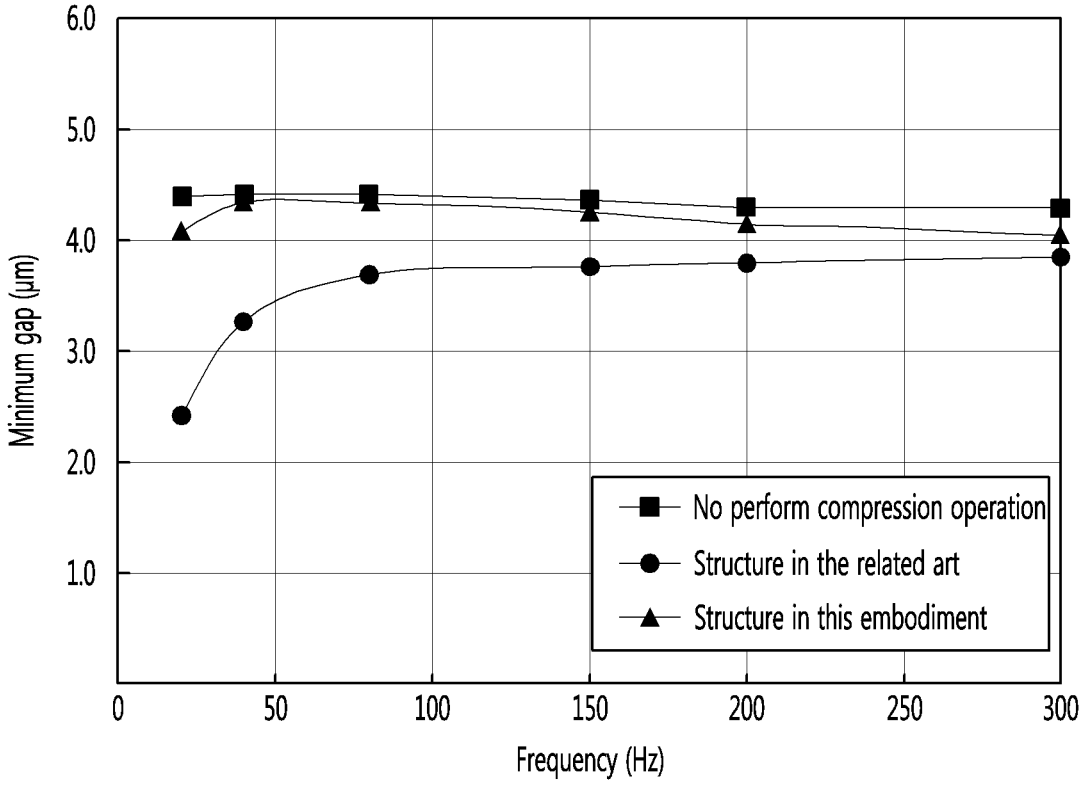
FIG. 11 is an experimental graph illustrating an example variation of a minimum gap between the cylinder and the piston according to a frequency of the piston while the piston operates.

FIG. 11 is an experimental graph illustrating a variation in minimum gap between the cylinder and the piston according to a frequency of the piston while the piston operates.

FIG. 11 illustrates an example minimum gap (μm) defined between the outer circumferential surface of the piston and the inner circumferential surface of the cylinder according to an operation frequency (Hz) of the linear compressor 10. As the minimum gap increases, possibility of the contact between the piston 130 and the cylinder 120 may increase. That is, the possibility of the friction between the piston 130 and the cylinder 120 may be reduced.

For example, when only a suctioning pressure is applied to the piston 130 without performing the compression operation, the minimum gap may be relatively large. When two cases (an experimental group and this implementation) in which the piston 130 performs the compression operation, the minimum gap may be relatively small.

In a piston in the related art without the refrigerant collection part 200, the minimum gap may be relatively small. For example, as shown in the drawings, it is seen that the minimum gap is a maximum 4 μm or less in a range of a frequency of about 20 Hz to about 300 Hz.

In a piston including the refrigerant collection part 200 according to this implementation, the minimum gap may be relatively large. For example, as shown in the drawings, it is seen that the minimum gap is a maximum 4 μm or more in the range of the frequency of about 20 Hz to about 300 Hz.

As described above, since the refrigerant collection part 200 according to this implementation is provided in the piston 130, the minimum gap between the piston 130 and the cylinder 120 may increase to reduce the interference of the piston 130 with respect to the cylinder 120.

Figure 12:
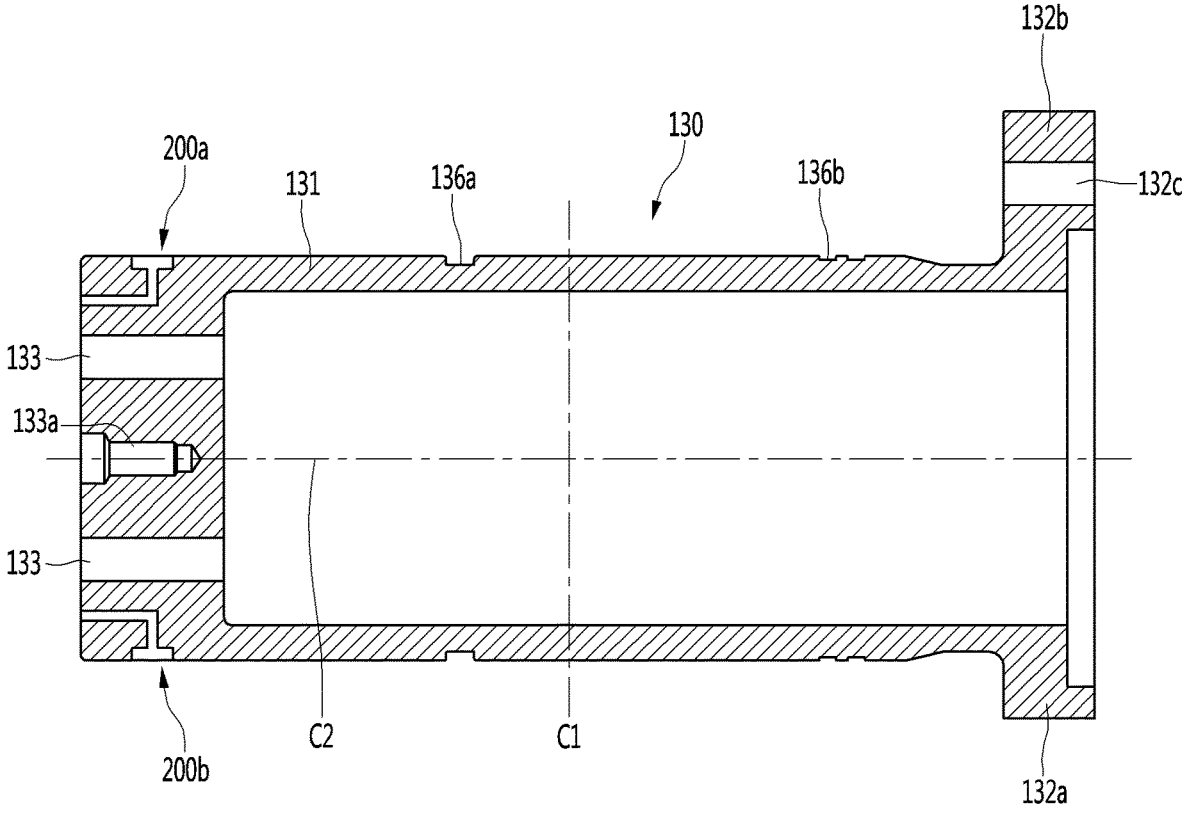
FIG. 12 is a cross-sectional view of another example piston.

FIG. 12 is a cross-sectional view of an example piston according to a second implementation.

FIG. 12 illustrates an example configuration of the piston. Here, different parts between the first and second implementations will be described principally, and a description of the same parts thereof will be omitted, and like reference numerals denote like elements throughout.

Referring to FIG. 12, the piston includes a plurality of refrigerant collection parts 200*a* and 200*b*. The refrigerant collection parts 200*a* and 200*b* include a first collection part 200*a* disposed on one side of a coupling hole 133*a* of the piston and a second collection part 200*b* disposed on the other side of the coupling hole 133*a*. Each of the first and second collection parts 200*a* and 200*b* will be derived from the refrigerant collection part 200 described.

As described above, since the plurality of refrigerant collection parts 200*a* and 200*b* are provided so that a refrigerant compressed in a compression chamber P is guided through a plurality of paths and then is stored, the compressed refrigerant may uniformly flow over an outer circumferential surface of the piston, and thus, a phenomenon in which the piston moves in a radial direction by force of the compressed refrigerant may be reduced.

Although the two refrigerant collection parts 200*a* and 200*b* are provided in this example, four refrigerant collection parts may be provided to correspond to four directions in which the suction ports are disposed. That is, when the piston front part 131*a* is viewed from a front side in FIG. 7, the refrigerant collection parts may be disposed outside the suction ports 133 in up/down and left/right directions. According to the above-described constituents, since the refrigerant compressed in the compression chamber P flows in the four directions and then is introduced into the refrigerant collection part, the phenomenon in which the piston moves to be lean to one direction by force of the compressed refrigerant may be prevented.

In some implementations, the compressor including the internal component may decrease in size to reduce the volume of the machine room of the refrigerator, and thus, the inner storage space of the refrigerant may increase.

In some examples, the driving frequency of the compressor may increase to prevent the internal component from being deteriorated in performance due to the decreasing size thereof. In addition, the gas bearing may be applied between the cylinder and the piston to reduce the friction force occurring by the oil.

In some examples, the refrigerant collection part may be provided in the piston to store the high-pressure refrigerant compressed in the compression chamber, and thus, the high-pressure refrigerant may be spread to the space between the inner circumferential surface of the cylinder and the outer circumferential surface of the piston to prevent the non-uniform gap between the inner circumferential surface of the cylinder and the outer circumferential surface of the piston from occurring.

Thus, the piston may move in the radial direction within the cylinder to prevent the piston from coming into contact with the cylinder. As a result, the loss due to the friction between the cylinder and the piston may be prevented to improve the compression efficiency.

In some examples, the refrigerant collection part may be disposed in the front portion of the piston that is close to the compression chamber. Thus, when the piston advances to compress the compression chamber, the compressed high-pressure refrigerant may be easily introduced into the refrigerant collection part, and then, the refrigerant may further flow to the rear side of the refrigerant collection part to prevent the gap between the inner circumferential surface of the cylinder and the outer circumferential surface of the piston from increasing.

In some examples, since the high-pressure refrigerant passes through the outer circumferential surface of the front portion of the piston and the inner circumferential surface of the front portion of the cylinder while the high-pressure refrigerant flows to the refrigerant collection part, the levitation force may act on the front portion of the piston to improve the effect of the gas bearing.

In some examples, after the refrigerant is compressed in and discharged from the compression chamber, while the piston moves backward to suction the low-pressure refrigerant into the compression chamber through the suction port, the refrigerant collected into the refrigerant collection part may be suctioned into the compression chamber through the opened suction valve. In some examples, when the refrigerant within the compression chamber is compressed, the high-pressure refrigerant may be collected again into the refrigerant collection part.

As described above, since the collection of the refrigerant into the refrigerant collection part and the suction of the refrigerant into the compression chamber are repeatedly performed, even though the compression cycle of the refrigerant is repeated, the friction between the piston and the cylinder due to the flow of the high-pressure refrigerant to the rear side of the piston may be prevented.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a cylinder that defines a compression chamber configured to accommodate refrigerant, the cylinder comprising a cylinder nozzle configured to receive refrigerant;

a piston provided in the cylinder and configured to be pressed by refrigerant in the cylinder, the piston comprising:

a piston body configured to move forward and backward within the cylinder, a piston front part located on a front surface of the piston body, the piston front part comprising a suction port through which refrigerant is supplied into the compression chamber, and a refrigerant collection part that is recessed from an outer circumferential surface of the piston front part that extends to a front surface of the piston front part; and a suction valve provided at a front side of the piston front part and configured to open and close the suction port, wherein the refrigerant collection part is in communication with the compression chamber and configured to receive and store at least a portion of refrigerant provided from the compression chamber (i) along the outer circumferential surface of the piston front part and (ii) through the cylinder nozzle to reduce force acting on the piston, wherein the refrigerant collection part defines a path from the outer circumferential surface of the piston front part to the front surface of the piston front part, the path comprising:

an inflow part defined at the outer circumferential surface of the piston front part, and a discharge part defined at the front surface of the piston front part and configured to be closed by the suction valve, and wherein the suction valve is configured to open and close the suction port and the discharge part together.

2. The linear compressor according to claim 1, wherein the piston body is spaced apart from the cylinder to define a gap part between an outer circumferential surface of the piston body and an inner circumferential surface of the cylinder, the gap part being in communication with the compression chamber to allow at least a portion of refrigerant compressed in the compression chamber to flow around the piston body.

3. The linear compressor according to claim 2, wherein the inflow part communicates with the gap part.

4. The linear compressor according to claim 3, wherein the refrigerant collection part further comprises a connection passage that is provided in the piston front part and that extends from the inflow part to the discharge part.

5. The linear compressor according to claim 4, wherein the connection passage comprises:

a first passage part connected to the inflow part and recessed from the outer circumferential surface of the piston front part; and a second passage part that extends from the first passage part to the discharge part.

6. The linear compressor according to claim 5, wherein the second passage part is bent from the first passage part toward the discharge part.

7. The linear compressor according to claim 5, wherein a cross-sectional area of the first passage part is greater than a cross-sectional area of the second passage part.

8. The linear compressor according to claim 1, wherein the suction valve is configured to, based on the piston moving forward to compress refrigerant in the compression chamber, close the suction port and the refrigerant collection part.

9. The linear compressor according to claim 1, wherein the suction valve is configured to, based on the piston moving backward, open the suction port and the refrigerant collection part to allow refrigerant to be introduced into the compression chamber through the suction port and the refrigerant collection part.

10. The linear compressor according to claim 1, further comprising a discharge valve provided at a side of the compression chamber and configured to open and close at least a portion of the compression chamber, wherein the discharge valve is configured to, based on the discharge valve opening at least the portion of the compression chamber, allow at least a portion of refrigerant compressed in the compression chamber to discharge from at least the portion of the compression chamber to the cylinder nozzle.

11. The linear compressor according to claim 1, wherein the path of the refrigerant collection part further comprises a first path that extends from the discharge part in a direction parallel to the suction port, and a second path that extends from the first path to the inflow part in a radial direction of the piston.

12. The linear compressor according to claim 11, wherein a width of the inflow part along the outer circumferential surface of the piston front part is less than widths of the first path and the second path.

13. The linear compressor according to claim 1, wherein the discharge part is spaced apart from the suction port in a radial direction of the piston and disposed radially inward relative to the outer circumferential surface of the piston front part.

14. A linear compressor comprising:

a cylinder that defines a compression chamber configured to receive refrigerant;

a piston provided in a side of the compression chamber and configured to move forward and backward in the compression chamber;

a suction port provided in the piston and configured to guide refrigerant to the compression chamber;

a suction valve coupled to a front surface of the piston and configured to open and close the suction port;

a gap part defined between an outer circumferential surface of the piston and an inner circumferential surface of the cylinder, the gap part being in communication with the compression chamber to allow at least a portion of refrigerant compressed in the compression chamber to flow through the gap part around the piston; and a refrigerant collection part that is recessed from the piston, that is in communication with the compression chamber and the gap part, and that is configured to receive and store at least a portion of refrigerant provided from the compression chamber along the outer circumferential surface of the piston to reduce force acting on the piston, wherein the refrigerant collection part defines a path from the outer circumferential surface of the piston to the front surface of the piston, the path comprising:

an inflow part defined at the outer circumferential surface of the piston and configured to communicate with the gap part, and a discharge part defined at the front surface of the piston and configured to be closed by the suction valve, and wherein the suction valve is configured to open and close the suction port and the discharge part together.

15. The linear compressor according to claim 14, wherein the refrigerant collection part further comprises a connection passage that extends from the inflow part to the discharge part.

16. The linear compressor according to claim 15, wherein the connection passage comprises:

a first passage part recessed from the outer circumferential surface of the piston; and a second passage part that extends from the first passage part to the front surface of the piston.

17. The linear compressor according to claim 14, further comprising:

a discharge valve provided at a side of the compression chamber and configured to discharge refrigerant compressed in the compression chamber; and a cylinder nozzle provided in the cylinder and configured to, based on the discharge valve being opened, guide, to the gap part, a portion of the refrigerant that is discharged from the compression chamber.

18. The linear compressor according to claim 17, wherein the cylinder nozzle comprises:

a first nozzle disposed at a front side with respect to a central line that crosses an axial direction of the cylinder; and a second nozzle disposed at a rear side with respect to the central line that crosses the axial direction of the cylinder.

19. The linear compressor according to claim 17, wherein the cylinder nozzle comprises a plurality of nozzles.

20. The linear compressor according to claim 14, wherein the suction valve is further configured to, based on a direction of movement of the piston in the cylinder, open and close the discharge part of the refrigerant collection part.

* * * * *